US010240107B2

(12) United States Patent
Cohrs et al.

(10) Patent No.: US 10,240,107 B2
(45) Date of Patent: Mar. 26, 2019

(54) LAUNDRY DETERGENTS CONTAINING SOIL RELEASE POLYMERS

(71) Applicant: Clariant International Ltd., Muttenz (CH)

(72) Inventors: Carsten Cohrs, Frankfurt am Main (DE); Dirk Fischer, Hahnheim (DE); Henricus Peerlings, Spabrücken (DE); Kevin Mutch, Frankfurt (DE)

(73) Assignee: Clariant International Ltd., Muttenz (CH)

( * ) Notice: Subject to any disclaimer, the term of this patent is extended or adjusted under 35 U.S.C. 154(b) by 0 days.

(21) Appl. No.: 15/525,407

(22) PCT Filed: Nov. 10, 2015

(86) PCT No.: PCT/EP2015/076273
§ 371 (c)(1),
(2) Date: May 9, 2017

(87) PCT Pub. No.: WO2016/075178
PCT Pub. Date: May 19, 2016

(65) Prior Publication Data

US 2017/0321154 A1 Nov. 9, 2017

(30) Foreign Application Priority Data

Nov. 11, 2014 (EP) ..... 14003782

(51) Int. Cl.

| | |
|---|---|
| ***C11D 1/00*** | (2006.01) |
| ***C11D 3/37*** | (2006.01) |
| ***C11D 3/00*** | (2006.01) |
| ***C11D 11/00*** | (2006.01) |

(52) U.S. Cl.
CPC ..... *C11D 3/0036* (2013.01); *C11D 3/3715* (2013.01); *C11D 11/0017* (2013.01)

(58) Field of Classification Search
CPC ..... C11D 1/00; C11D 3/37
See application file for complete search history.

(56) References Cited

U.S. PATENT DOCUMENTS

| | | | |
|---|---|---|---|
| 2,182,306 | A | 12/1936 | Heinrich et al. |
| 2,208,095 | A | 7/1940 | Essselmann et al. |
| 2,553,696 | A | 5/1951 | Wilson |
| 2,806,839 | A | 9/1957 | Crowther et al. |
| 3,033,746 | A | 5/1962 | Moyle et al. |
| 3,893,929 | A | 7/1975 | Basadur |
| 3,959,230 | A | 5/1976 | Hays |
| 3,962,152 | A | 6/1976 | Nicol et al. |
| 4,132,680 | A | 1/1979 | Nicol |

(Continued)

FOREIGN PATENT DOCUMENTS

| | | |
|---|---|---|
| DE | 102007013217 | 9/2008 |
| EP | 0199403 | 10/1986 |

(Continued)

OTHER PUBLICATIONS

U.S. Appl. No. 14/418,681, now published as U.S. Appl. No. 9,732,308.

(Continued)

*Primary Examiner* — Brian P Mruk
(74) *Attorney, Agent, or Firm* — Tod A. Waldrop

(57) ABSTRACT

The invention relates to liquid laundry detergent compositions comprising a) one or more polyesters comprising one or more of the repeating structural unit (a1) and one or more of the repeating structural unit (a2)

(a1)

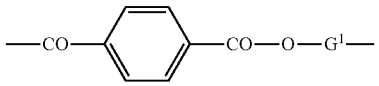

(a2)

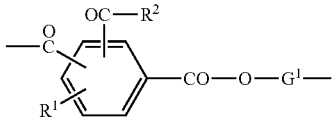

wherein $G^1$ is one or more of $(C_nH_{2n}O)$ with n being a number of from 2 to 10, $R^1$ is H or $COR^2$, $R^2$ is X—$(C_3H_6O)_p$—$(C_2H_4O)_q$—Y wherein X is NH or O, Y is a $C_{1-30}$ alkyl, the $(C_3H_6O)$— and $(C_2H_4O)$-groups may be arranged blockwise, alternating, periodically and/or statistically and wherein the connections of the groups $(C_3H_6O)$— and $(C_2H_4O)$— to X— and —Y are free to vary, or O-$G^1$-H, p is based on a molar average, a number of from 0 to 60, q is based on a molar average, a number of from 1 to 300, and b) one or more surfactants.

The one or more polyesters of component a) possess advantageous stability in alkaline environments, possess beneficial solubility and advantageously are clearly soluble in alkaline compositions such as liquid laundry detergent compositions and also possess advantageous soil release and soil removal properties on fatty and oily stains.

16 Claims, No Drawings

(56) References Cited

U.S. PATENT DOCUMENTS

| | | | | |
|---|---|---|---|---|
| 4,702,857 | A * | 10/1987 | Gosselink | C08G 63/66 510/299 |
| 4,711,730 | A | 12/1987 | Gosselink et al. | |
| 4,713,194 | A | 12/1987 | Gosselink | |
| 4,759,876 | A | 7/1988 | Crossin | |
| 9,365,806 | B2 | 6/2016 | Carswell et al. | |
| 2009/0036641 | A1 | 2/2009 | Lang et al. | |
| 2015/0166938 | A1 | 6/2015 | Fischer et al. | |
| 2015/0203630 | A1 | 7/2015 | Fischer et al. | |
| 2015/0218491 | A1 | 8/2015 | Morschhaeuser et al. | |
| 2015/0240029 | A1 | 8/2015 | Fischer et al. | |
| 2017/0145348 | A1 | 5/2017 | Klug et al. | |
| 2017/0327773 | A1 | 11/2017 | Cohrs et al. | |

FOREIGN PATENT DOCUMENTS

| | | | |
|---|---|---|---|
| EP | 1966273 | 7/2007 | |
| GB | 1088984 | 10/1967 | |
| GB | 1466639 | 3/1977 | |
| WO | WO 2007079850 | 7/2007 | |
| WO | WO 2007138054 | 12/2007 | |
| WO | WO 2014/019903 | * 2/2014 | C08G 63/183 |
| WO | WO 2014019658 | 2/2014 | |
| WO | WO 2014019903 | 2/2014 | |

OTHER PUBLICATIONS

U.S. Appl. No. 14/418,703, now published as U.S. Pat. No. 2015-0203630.

U.S. Appl. No. 14/421,963, now published as U.S. Pat. No. 2015-0240029.

U.S. Appl. No. 14/421,970, now published as U.S. Pat. No. 2015-0218491.

U.S. Appl. No. 14/417,410, now patented as U.S. Appl. No. 9,365,806.

U.S. Appl. No. 15/324,143, now published as U.S. Pat. No. 2017-0145348.

U.S. Appl. No. 15/525,456, now published as U.S. Pat. No. 2017-0327773.

International Search Report for PCT/EP2015/076273, dated Feb. 12, 2016.

Written Opinion of the International Searching Authoirty for PCT/EP2015/076273, dated Feb. 12, 2016.

Machine translation of DE 102007013217, dated Sep. 18, 2008.

* cited by examiner

LAUNDRY DETERGENTS CONTAINING SOIL RELEASE POLYMERS

This invention relates to liquid laundry detergent compositions comprising soil release polymers with improved hydrolytic stability. The compositions display good soil release performance, as well as advantageous soil removal compared to compositions containing no soil release polymer.

Polyester containing fabrics can be surface modified to increase the hydrophilicity of the fabric, which can improve soil removal. Such surface modification can be achieved through direct treatment of the fabric, as outlined for example in GB 1,088,984, or more preferably through deposition of a surface modifying polymer in a washing process, as disclosed for example in U.S. Pat. No. 3,962,152. The renewable soil release finish imparted through washing ensures the continuous protection of the fiber from oily stains.

The polymers used in these processes typically consist of a polyester midblock with either one or two endblocks of polyethylene glycol, as further outlined in U.S. Pat. No. 3,959,230 and U.S. Pat. No. 3,893,929.

The inclusion of anionic moieties in the polymer structure is known to improve the efficacy of these soil release polymers and in particular, improve their anti-redeposition properties. For example, DE 10 2007 013 217 and EP 1 966 273 disclose anionic polyesters that may be used as soil release agents in laundry detergents. Such anionic soil release polymers are particularly well suited for use in powder detergents due to handling and compatibility with the detergent composition.

The use of nonionic soil release agents in liquid laundry detergents is well known in the art. GB 1,466,639, U.S. Pat. Nos. 4,132,680, 4,702,857, EP 0 199 403, U.S. Pat. Nos. 4,711,730, 4,713,194 and 4,759,876 disclose aqueous detergent compositions containing soil release polymers.

One of the major challenges for the existing soil release polymers described in the prior art, is their susceptibility to hydrolysis under alkaline conditions, as is usually the case in liquid laundry detergent compositions.

Therefore, the problem to be solved by the present invention was to provide liquid laundry detergent compositions possessing good soil release performance with advantageous storage stability.

Surprisingly, it has been found that this problem can be solved through the incorporation of one or more polyesters comprising one or more of the repeating structural unit (a1) and one or more of the repeating structural unit (a2)

(a1)

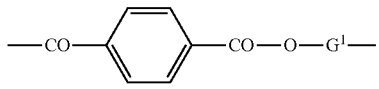

(a2)

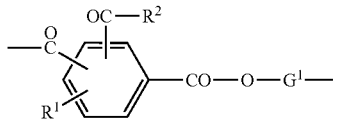

wherein $G^1$ is one or more of $(C_nH_{2n}O)$ with n being a number of from 2 to 10, preferably from 2 to 6 and more preferably $(C_2H_4O)$, $(C_3H_6O)$, $(C_4H_8O)$ or $(C_6H_{12}O)$, $R^1$ is H or $COR^2$, $R^2$ is $X—(C_3H_6O)_p—(C_2H_4O)_q—Y$ wherein X is NH or O, Y is a $C_{1-30}$ alkyl, preferably $C_{1-4}$ alkyl and more preferably methyl, the $(C_3H_6O)$— and $(C_2H_4O)$-groups may be arranged blockwise, alternating, periodically and/or statistically, preferably blockwise and/or statistically, and wherein the connections of the groups $(C_3H_6O)$— and $(C_2H_4O)$— to X— and —Y are free to vary, or $O\text{-}G^1\text{-}H$, preferably $X—(C_2H_6O)_p—(C_2H_4O)_q—Y$, p is based on a molar average, a number of from 0 to 60, preferably from 0 to 30 and more preferably from 0 to 15, q is based on a molar average, a number of from 1 to 300, preferably from 5 to 120 and more preferably from 15 to 50, into liquid laundry detergent compositions comprising one or more surfactants.

Therefore, the subject matter of the present invention is liquid laundry detergent compositions comprising a) one or more polyesters comprising one or more of the repeating structural unit (a1) and one or more of the repeating structural unit (a2)

(a1)

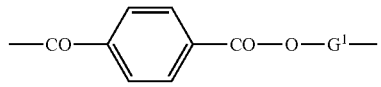

(a2)

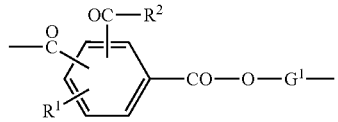

wherein $G^1$ is one or more of $(C_nH_{2n}O)$ with n being a number of from 2 to 10, preferably from 2 to 6 and more preferably $(C_2H_4O)$, $(C_3H_6O)$, $(C_4H_8O)$ or $(C_6H_{12}O)$, $R^1$ is H or $COR^2$, $R^2$ is $X—(C_3H_6O)_p—(C_2H_4O)_q—Y$ wherein X is NH or O, Y is a $C_{1-30}$ alkyl, preferably $C_{1-4}$ alkyl and more preferably methyl, the $(C_3H_6O)$— and $(C_2H_4O)$-groups may be arranged blockwise, alternating, periodically and/or statistically, preferably blockwise and/or statistically, and wherein the connections of the groups $(C_3H_6O)$— and $(C_2H_4O)$— to X— and —Y are free to vary, or $O\text{-}G^1\text{-}H$, preferably $X—(C_3H_6O)_p—(C_2H_4O)_q—Y$, p is based on a molar average, a number of from 0 to 60, preferably from 0 to 30 and more preferably from 0 to 15, q is based on a molar average, a number of from 1 to 300, preferably from 5 to 120 and more preferably from 15 to 50, and b) one or more surfactants.

The inventive liquid laundry detergent compositions exhibit liquid properties under standard temperature and pressure.

In the repeating structural unit (a2), the groups $R^1$, CO and $COR^2$ may be bonded to any of the five free positions on the aromatic ring, preferably the positions which would arise upon reaction of trimellitic acid anhydride or pyromelltic acid dianhydride.

In the case of trimellitic acid anhydride, where $R^1$ is H, the bonding sites of the three non-hydrogen groups may be represented as follows:

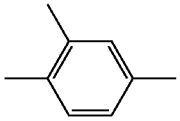

Preferably, in the case of trimellitic acid anhydride, the groups CO and $COR^2$ in the repeating structural unit (a2) may adopt either of the following configurations:

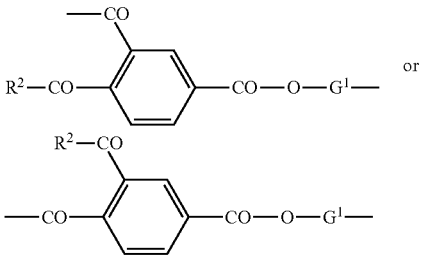

In the case of pyromellitic acid dianhydride, where $R^1$ is $COR^2$, the bonding sites of the four non-hydrogen groups are represented as follows:

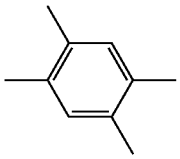

Preferably, in the case of pyromellitic acid dianhydride, the groups CO, $COR^2$ and $R^1$ ($R^1$ in this case also being $COR^2$) in the repeating structural unit (a2) may adopt either of the following configurations:

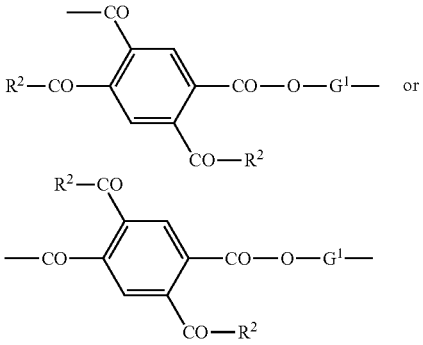

In the case that the inventive liquid laundry detergent composition comprises more than one polyester molecule of component a), the definition of the group $G^1$ of the repeating structural unit (a1) may vary between those polyester molecules. Furthermore, in the case that one polyester molecule of component a) comprises more than one of the repeating structural unit (a1), the definition of the group $G^1$ may vary between those repeating structural units.

In the case that the inventive liquid laundry detergent composition comprises more than one polyester molecule of component a), the definition of each of the groups $R^1$, $G^1$ and $R^2$ of the repeating structural unit (a2) may vary between those polyester molecules. Furthermore, in the case that one polyester molecule of component a) comprises more than one of the repeating structural unit (a2), the definition of each of the groups $R^1$, $G^1$ and $R^2$ may vary between those repeating structural units.

The $(C_3H_6O)$— and $(C_2H_4O)$-groups of $R^2$ may be arranged blockwise, alternating, periodically and/or statistically, preferably blockwise and/or statistically. This means that within one instance of the group $R^2$, the groups $(C_3H_6O)$— and $(C_2H_4O)$— may be arranged, for example, in a purely statistically or blockwise form but may also be arranged in a form which could be considered as both statistical and blockwise, e.g. small blocks of $(C_3H_6O)$— and $(C_2H_4O)$— arranged in a statistical manner, or in a form wherein adjacent instances of statistical and blockwise arrangements of the groups $(C_3H_6O)$— and $(C_2H_4O)$— exist.

The connections of the groups $(C_3H_6O)$— and $(C_2H_4O)$— to X— and —Y are free to vary. This means for example, that both X— and —Y may be connected to a $(C_3H_6O)$— group, they may both be connected to a $(C_2H_4O)$— group or they may be connected to different groups selected from $(C_2H_4O)$— and $(C_3H_6O)$—.

WO 2014/019658 and WO 2014/019659 describe linear soil release polymers with advantageous alkaline stability brought about through the inclusion of a small number of propylene oxide units in the endblock. The use of such polymers in a liquid laundry detergent is described in WO 2014/011903.

One advantage of the inventive liquid laundry detergent compositions, is the hydrolytic stability of the one or more soil release polyesters of component a).

The inventive liquid laundry detergent compositions may contain water as the main solvent or alternatively organic solvents or hydrotropes commonly used in liquid laundry detergent compositions, such as monoproylene glycol, glycerol, ethanol and other glycols. Systems containing low amounts of water are particularly suited to single dose formats such as pouches or capsules, whereby high levels of water can damage the water soluble coating of the pouch.

In the one or more polyesters of component a) of the inventive liquid laundry detergent compositions, the one or more repeating structural units (a2) are preferably selected from the group consisting of the repeating structural units (a2.1) and (a2.2).

(a2.1)

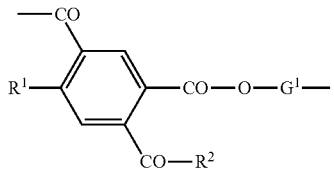

(a2.2)

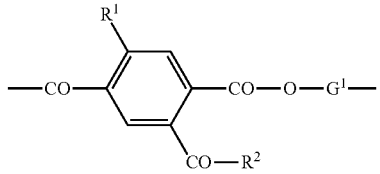

In the one or more polyesters of component a) of the inventive liquid laundry detergent compositions, X, in the definition of $R^2$, is preferably NH.

In the one or more polyesters of component a) of the inventive liquid laundry detergent compositions, the sum of p and q, based on a molar average, is preferably a number of from 1 to 360, more preferably a number of from 5 to 150 and even more preferably a number of from 15 to 65.

In one preferred embodiment of the liquid laundry detergent compositions, the one or more polyesters of component a) additionally comprise one or more of the repeating structural unit (a3)

(a3)

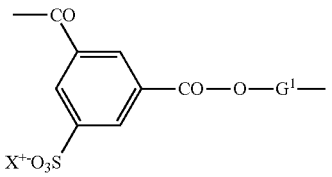

wherein $G^1$ is one or more of $(C_nH_{2n}O)$ with n being a number of from 2 to 10, preferably from 2 to 6 and more preferably $(C_2H_4O)$, $(C_3H_6O)$, $(C_4H_8O)$ or $(C_6H_{12}O)$, and $X^+$ is a counter-ion, preferably $Na^+$, $K^+$, $Ca^{2+}/2$ or $NH_4^-$, and more preferably $Na^+$.

Preferably, the average molecular weight ($M_w$) of the one or more polyesters of component a) of the inventive liquid laundry detergent compositions is from 3000 to 40000 g/mol.

The average molecular weight ($M_w$) of the one or more polyesters of component a) of the inventive liquid laundry detergent compositions may be determined by GPC analysis, preferably as detailed in the following: 10 μl of sample is injected onto a PSS Suprema column of dimensions 300×8 mm with porosity 30 Å and particle size 10 μm. The detection is monitored at 235 nm on a multiple wavelength detector. The employed eluent is 1.25 g/l of disodium hydrogen phosphate in a 45/55% (v/v) water/acetonitrile mixture. Separations are conducted at a flow-rate of 0.8 ml/min. Quantification is performed by externally calibrating standard samples of different molecular weight polyethylene glycols.

In the one or more polyesters of component a) of the inventive liquid laundry detergent compositions, the average number of repeating structural unit (a1) is preferably from 2 to 200, more preferably from 2 to 90, even more preferably from 3 to 75 and extraordinarily preferably from 3 to 45, and the average number of repeating structural unit (a2) is preferably from 1 to 25 and more preferably from 1 to 15.

In the one or more polyesters of component a) of the inventive liquid laundry detergent compositions, the ratio of the average number of repeating structural unit (a1) to the average number of repeating structural unit (a2) is preferably from 2 to 8 and more preferably from 3 to 5.

In the one or more polyesters of component a) of the inventive liquid laundry detergent compositions, the total amount of repeating structural units (a1) and (a2), based on the total weight of the one or more polyesters of component a) in the liquid laundry detergent composition, is preferably at least 30 wt.-%, more preferably at least 50 wt.-%, even more preferably at least 80 wt.-% and extraordinarily preferably at least 90 wt.-%.

In the one or more polyesters of component a) of the inventive liquid laundry detergent compositions, the amount of repeating structural unit (a3), based on the total weight of the one or more polyesters of component a) in the liquid laundry detergent composition, is preferably at least 0.1 wt.-%, more preferably from 0.1 wt.-% to 25 wt.-%, and even more preferably from 0.5 wt.-% to 20 wt.-%.

In one preferred embodiment of the invention, the one or more repeating structural units of the polyesters of component a) of the inventive liquid laundry detergent compositions, are exclusively selected from the group consisting of repeating structural units (a1) and (a2).

In a further preferred embodiment of the inventive liquid laundry detergent compositions, the one or more polyesters of component a), described in the following and further referred to as "Polyester A", comprise repeating structural units exclusively selected from the group consisting of the repeating structural units (a1) and (a2), whereby one or more of the repeating structural unit (a1) and one or more of the repeating structural unit (a2) must be present (a1)

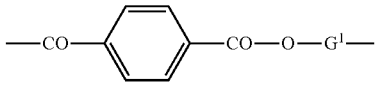

(a2)

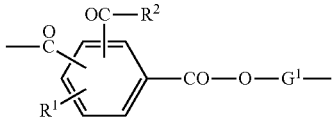

wherein $G^1$ is $(C_3H_6O)$, $R^1$ is H, $R^2$ is $X—(C_3H_6O)_p—(C_2H_4O)_q—Y$ wherein X is NH, Y is a $C_{1-30}$ alkyl, preferably $C_{1-4}$ alkyl and more preferably methyl, the $(C_3H_6O)$— and $(C_2H_4O)$-groups may be arranged blockwise, alternating, periodically and/or statistically, preferably statistically, and wherein the connections of the groups $(C_3H_6O)$— and $(C_2H_4O)$— to X— and —Y are free to vary, or O-$G^1$-H, preferably $X—(C_3H_6O)_p—(C_2H_4O)_q—Y$, p is based on a molar average, a number of from 0 to 15, preferably from 2 to 15, and more preferably from 5 to 14, q is based on a molar average, a number of from 12 to 120, preferably from 20 to 50, more preferably from 25 to 40, and even more preferably from 30 to 40.

In the one or more Polyesters A, the average number of repeating structural unit (a1) is preferably from 2 to 15, more preferably from 4 to 14, and even more preferably from 6 to 12.

In the one or more Polyesters A, the average number of repeating structural unit (a2) is preferably from 1 to 10, more preferably from 1 to 5, and even more preferably from 1 to 3.

In the one or more Polyesters A, the ratio of the average number of repeating structural unit (a1) to the average number of repeating structural unit (a2) is preferably from 2 to 8, more preferably from 3 to 5 and even more preferably 4. In another further preferred embodiment of the inventive liquid laundry detergent compositions, the one or more polyesters of component a), described in the following and further referred to as "Polyester B", comprise repeating structural units exclusively selected from the group consisting of the repeating structural units (a1) and (a2), whereby one or more of the repeating structural unit (a1) and one or more of the repeating structural unit (a2) must be present (a1)

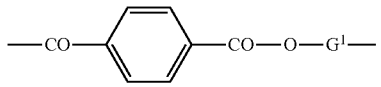

(a2)

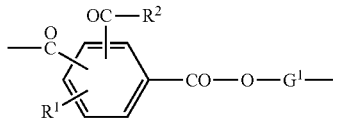

wherein $G^1$ is $(C_3H_6O)$, $R^1$ is H, $R^2$ is $X—(C_3H_6O)_p—(C_2H_4O)_q—Y$ wherein X is O, Y is a $C_{1-30}$ alkyl, preferably $C_{1-4}$ alkyl and more preferably methyl, the $(C_3H_6O)$— and $(C_2H_4O)$-groups may be arranged blockwise, alternating, periodically and/or statistically and wherein the connections of the groups $(C_3H_6O)$— and $(C_2H_4O)$— to X— and Y are free to vary, preferably blockwise wherein the $(C_3H_6O)$-block is connected to X— and the $(C_2H_4O)$-block is connected to Y, or O-$G^1$-H, preferably $X—(C_3H_6O)_p—(C_2H_4O)_q—Y$, p is based on a molar average, a number of from 0 to 20, preferably from 0 to 10, and more preferably from 0 to 5, q is based on a molar average, a number of from 12 to 120, preferably from 30 to 60, and more preferably from 40 to 50.

In the one or more Polyesters B, the average number of repeating structural unit (a1) is preferably from 20 to 70, more preferably from 25 to 55, and even more preferably from 35 to 45.

In the one or more Polyesters B, the average number of repeating structural unit (a2) is preferably from 1 to 15, more preferably from 5 to 13, and even more preferably from 8 to 12.

In the one or more Polyesters B, the ratio of the average number of repeating structural unit (a1) to the average number of repeating structural unit (a2) is preferably from 2 to 8, more preferably from 3 to 5 and even more preferably 4.

In another further preferred embodiment of the inventive liquid laundry detergent compositions, the one or more polyesters of component a), described in the following and further referred to as "Polyester C", comprise repeating structural units exclusively selected from the group consisting of the repeating structural units (a1) and (a2), whereby one or more of the repeating structural unit (a1) and one or more of the repeating structural unit (a2) must be present (a1)

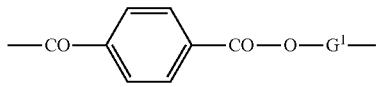

(a2)

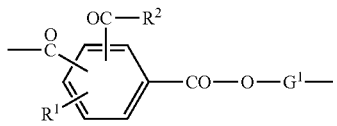

wherein $G^1$ is a mixture of $(C_3H_6O)$ and $(C_4H_8O)$, mixed in a ratio of preferably from 3 to 5 parts $(C_3H_6O)$ to 1 part $(C_4H_8O)$, $R^1$ is H, $R^2$ is $X—(C_3H_6O)_p—(C_2H_4O)_q—Y$ wherein X is NH, Y is a $C_{1-30}$ alkyl, preferably $C_{1-4}$ alkyl and more preferably methyl, the $(C_3H_6O)$— and $(C_2H_4O)$-groups may be arranged blockwise, alternating, periodically and/or statistically, preferably statistically, and wherein the connections of the groups $(C_3H_6O)$— and $(C_2H_4O)$— to X— and —Y are free to vary, or O-$G^1$-H, preferably $X—(C_3H_6O)_p—(C_2H_4O)_q—Y$, p is based on a molar average, a number of from 0 to 15, preferably from 2 to 15, and more preferably from 5 to 14, q is based on a molar average, a number of from 12 to 120, preferably from 20 to 50, more preferably from 25 to 40, and even more preferably from 30 to 40.

In the one or more Polyesters C, the average number of repeating structural unit (a1) is preferably from 2 to 15, more preferably from 4 to 14, and even more preferably from 6 to 12.

In the one or more Polyesters C, the average number of repeating structural unit (a2) is preferably from 1 to 10, more preferably from 1 to 5, and even more preferably from 1 to 3.

In the one or more Polyesters C, the ratio of the average number of repeating structural unit (a1) to the average number of repeating structural unit (a2) is preferably from 2 to 8, more preferably from 3 to 5 and even more preferably 4.

In another further preferred embodiment of the inventive liquid laundry detergent compositions, the one or more polyesters of component a), described in the following and further referred to as "Polyester D", comprise repeating structural units exclusively selected from the group consisting of the repeating structural units (a1) and (a2), whereby one or more of the repeating structural unit (a1) and one or more of the repeating structural unit (a2) must be present (a1)

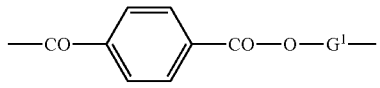

(a2)

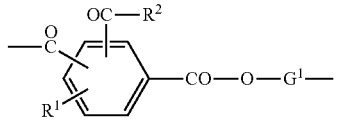

wherein $G^1$ is $(C_3H_6O)$, $R^1$ is $COR^2$, $R^2$ is $X—(C_3H_6O)_p—(C_2H_4O)_q—Y$ wherein X is NH, Y is a $C_{1-30}$ alkyl, preferably $C_{1-4}$ alkyl and more preferably methyl, the $(C_3H_6O)$— and $(C_2H_4O)$-groups may be arranged blockwise, alternating, periodically and/or statistically, preferably statistically, and wherein the connections of the groups $(C_3H_6O)$— and $(C_2H_4O)$— to X— and —Y are free to vary, or O-$G^1$-H, preferably $X—(C_3H_6O)_p—(C_2H_4O)_q—Y$, p is based on a molar average, a number of from 0 to 15, preferably from 2 to 15, and more preferably from 5 to 14, q is based on a molar average, a number of from 12 to 120, preferably from 20 to 50, more preferably from 25 to 40, and even more preferably from 30 to 40.

In the one or more Polyesters D, the average number of repeating structural unit (a1) is preferably from 3 to 20, more preferably from 4 to 15, and even more preferably from 4 to 10.

In the one or more Polyesters D, the average number of repeating structural unit (a2) is preferably from 1 to 10, more preferably from 1 to 5, and even more preferably from 1 to 3.

In the one or more Polyesters D, the ratio of the average number of repeating structural unit (a1) to the average number of repeating structural unit (a2) is preferably from 2 to 8, and more preferably from 3 to 7.

The average molecular weight ($M_w$) of the one or more of Polyesters A, B, C, and D is preferably from 3000 to 40000 g/mol.

In the Polyesters A, B, C and D, the total amount of repeating structural units (a1) and (a2), based on the total weight of the one or more Polyesters A, B, C and D, is preferably at least 30 wt.-%, more preferably at least 50 wt.-%, even more preferably at least 80 wt.-% and extraordinarily preferably at least 90 wt.-%.

The one or more polyesters of component a) contained in the inventive liquid laundry detergent compositions, have an advantageous stability in alkaline environment, possess beneficial solubility and advantageously are clearly soluble in alkaline compositions such as liquid laundry detergent compositions and also possess advantageous soil release properties and soil removal properties (primary detergency) on fatty and oily stains.

The groups —$C_2H_4O$ in the structural units "X—$(C_3H_6O)_p$—$(C_2H_4O)_q$—Y" and in the structural units $G^1$ are of the formula —$CH_2$—$CH_2$—O—.

The groups —$C_3H_6O$ in the structural units "X—$(C_3H_6O)_p$—$(C_2H_4O)_q$—Y" and in the structural units $G^1$ are of the formula —$CH(CH_3)$—$CH_2$—O— or —$CH_2$—$CH(CH_3)$—O—, i.e. of the formula

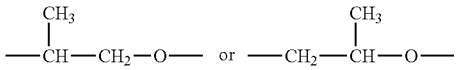

The groups ($C_4H_8O$) in the structural units $G^1$ are preferably of the formula —$CH(CH_3)$—$CH(CH_3)$—O—, i.e. of the formula

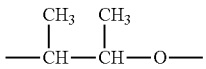

The groups ($C_6H_{12}O$) in the structural units $G^1$ are preferably of the formula —$CH_2$—CH(n-$C_4H_9$)—O— or —CH(n-$C_4H_9$)—$CH_2$—O—, i.e. of the formula

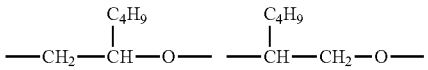

The one or more polyesters of component a) of the inventive liquid laundry detergent compositions comprise, besides the one or more repeating structural units, terminal groups. The terminal groups are preferably selected from the group consisting of H, OH, $OCH_3$, $HOG^1$, $R^2$, $CO(C_6H_4)COR^2$ and $CO(C_6H_2)COR^2R^1COR^2$. The terminal groups connected to the CO group of the repeating structural units (a1) and (a2) are preferably selected from the group consisting of HO, $OCH_3$, $HOG^1$ and $R^2$. The terminal groups connected to the $G^1$ group of the repeating structural units (a1) and (a2) are preferably selected from the group consisting of H, $CO(C_6H_4)COR^2$ and $CO(C_6H_2)COR^2R^1COR^2$ and are more preferably H.

In one preferred embodiment of the invention, all of the terminal groups of the repeating structural units (a1) and (a2) of the polyesters of component a) of the inventive liquid laundry detergent compositions, are chosen from the group consisting of $R^2$, $CO(C_6H_4)COR^2$ and $CO(C_6H_2)COR^2R^1COR^2$ whereby $CO(C_6H_4)COR^2$ is given by the formula:

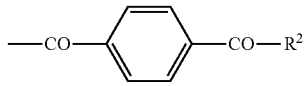

and $CO(C_6H_2)COR^2R^1COR^2$ is given by the formula:

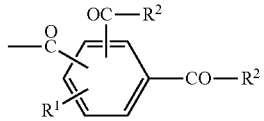

wherein $R^2$ is X—$(C_3H_6O)_p$—$(C_2H_4O)_q$—Y, X is NH or O, Y is a $C_{1-30}$alkyl, preferably $C_{1-4}$ alkyl and more preferably methyl, the ($C_3H_6O$)— and ($C_2H_4O$)-groups may be arranged blockwise, alternating, periodically and/or statistically, preferably blockwise and/or statistically, and wherein the connections of the groups ($C_3H_6O$)— and ($C_2H_4O$)— to X— and —Y are free to vary, or O-$G^1$-H, preferably X—$(C_3H_6O)_p$-$(C_2H_4O)_q$—Y, p is based on a molar average, a number of from 0 to 60, preferably from 0 to 30 and more preferably from 0 to 15, and q is based on a molar average, a number of from 1 to 300, preferably from 5 to 120 and more preferably from 15 to 50.

A subject matter of the present invention is liquid laundry detergent compositions comprising a) one or more polyesters obtainable through a polymerization reaction of the following monomers:

I) dimethyl terephthalate, and

II) one or more alkylene glycols of the formula $HOC_nH_{2n}OH$, with n being a number of from 2 to 10, preferably from 2 to 6 and more preferably ($HOC_2H_4OH$), ($HOC_3H_6OH$), ($HOC_4H_8OH$) or ($HOC_6H_{12}OH$), and III) one or more alkyl capped polyalkylene glycols of the formula $$X^a—(C_3H_6O)_p—(C_2H_4O)_q—Y$$

wherein $X^a$ is $NH_2$ or OH,

Y is a $C_{1-30}$ alkyl, preferably a $C_{1-4}$ alkyl and more preferably methyl, the ($C_3H_6O$)— and ($C_2H_4O$)-groups may be arranged blockwise, alternating, periodically and/or statistically, preferably blockwise and/or statistically, and wherein the connections of the groups ($C_3H_6O$)— and ($C_2H_4O$)— to $X^a$— and —Y are free to vary, p is based on a molar average a number of from 0 to 60, preferably from 0 to 30 and more preferably from 0 to 15, q is based on a molar average a number of from 1 to 300, preferably from 5 to 120 and more preferably from 15 to 50, and IV) one or more acids of the formula:

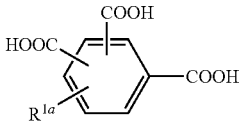

wherein $R^{1a}$ is H or COOH, or the respective anhydrides thereof, preferably trimellitic acid anhydride or pyromellitic acid dianhydride, and V) optionally one or more further monomers, that are different from the monomers I) to IV), preferably selected from the group consisting of aromatic dicarboxylic acids, their derivatives and the salts thereof, more preferably phthalic acid, isophthalic acid, 3-sulfophthalic acid, 4-sulfophthalic acid, 5-sulfoisophthalic acid and their salts, and even more preferably 5-sulfoisophthalic acid and its salts, and b) one or more surfactants.

The polyesters of component a) obtainable through a polymerization reaction of the monomers I), II), III), IV) and optionally V) are referred to in the following as "Polyesters Z".

$X^a$, in the definition of monomer III), is preferably $NH_2$.

The sum of p and q in the monomer III), based on a molar average, is preferably a number of from 1 to 360, more preferably a number of from 5 to 150 and even more preferably a number of from 15 to 65.

The one or more optional monomers V) are preferably selected from the group consisting of 5-sulfoisophthalic acid and its salts. Preferably the salts are selected from the group consisting of sodium, potassium, calcium and ammonium salts and more preferably the salt is the sodium salt.

Preferably, the average molecular weight of the Polyesters Z contained in the inventive liquid laundry detergent compositions is from 3000 to 40000 g/mol.

In the one or more Polyesters Z contained in the inventive liquid laundry detergent compositions, the average number of repeating structural units resulting from monomer I) in the polymerization is preferably from 2 to 200, more preferably from 2 to 90, even more preferably from 3 to 75 and extraordinarily preferably from 3 to 45, and the average number of repeating structural units resulting from the one or more monomers IV) in the polymerization is preferably from 1 to 25 and more preferably from 1 to 15.

In the one or more Polyesters Z contained in the inventive liquid laundry detergent compositions, the ratio of the average number of repeating structural units resulting from monomer I) in the polymerization to the average number of repeating structural units resulting from the one or more monomers IV) in the polymerization is preferably from 2 to 8 and more preferably from 3 to 5.

Preferably, the amount of the one or more Polyesters Z resulting from monomers I), II), III) and IV) in the polymerization, based on the total weight of the one or more Polyesters Z and excluding two terminal groups, is at least 30 wt.-%, more preferably at least 50 wt.-%, even more preferably at least 80 wt.-% and extraordinarily preferably at least 90 wt.-%.

In the one or more Polyesters Z, the amount of polymer resulting from the one or more optional monomers V) in the polymerization, based on the total weight of the one or more Polyesters Z, is preferably at least 0.1 wt.-%, more preferably from 0.1 wt.-% to 25 wt.-% and even more preferably from 0.5 wt.-% to 20 wt.-%.

Preferably, the one or more Polyesters Z contained in the inventive liquid laundry detergent compositions are obtainable through polymerizing exclusively the monomers I), II), III) and IV).

In one preferred embodiment of the invention, the one or more Polyesters Z contained in the inventive liquid laundry detergent compositions, are obtainable by first synthesizing a precursor through complete reaction of monomers III) and IV) before further reacting with monomers I), II) and optionally V).

In another preferred embodiment of the invention, the one or more Polyesters Z contained in the inventive liquid laundry detergent compositions, are obtainable through direct reaction of monomers I), II), III), IV) and optionally V).

In a further preferred embodiment of the inventive liquid laundry detergent compositions, the one or more polyesters of component a), described in the following and further referred to as "Polyester $A^a$", are obtainable through a polymerization reaction of the following monomers:

I) dimethyl terephthalate, and

II) ($HOC_3H_6OH$), and

III) one or more alkyl capped polyalkylene glycols of the formula $$X^a—(C_3H_6O)_p—(C_2H_4O)_q—Y$$

wherein $X^a$ is $NH_2$,

Y is a $C_{1-30}$ alkyl, preferably a $C_{1-4}$ alkyl and more preferably methyl, the $(C_3H_6O)$— and $(C_2H_4O)$-groups may be arranged blockwise, alternating, periodically and/or statistically, preferably statistically, and wherein the connections of the groups $(C_3H_6O)$— and $(C_2H_4O)$— to X— and —Y are free to vary, p is based on a molar average a number of from 0 to 15, preferably from 2 to 15 and more preferably from 5 to 14, q is based on a molar average a number of from 12 to 120, preferably from 20 to 50, more preferably from 25 to 40, and even more preferably from 30 to 40, and IV) trimellitic acid anhydride.

In the one or more Polyesters $A^a$, the average number of repeating structural units resulting from monomer I) in the polymerization is preferably from 2 to 15, more preferably from 4 to 14, and even more preferably from 6 to 12.

In the one or more Polyesters $A^a$, the average number of repeating structural units resulting from the one or more monomers IV) in the polymerization is preferably from 1 to 10, more preferably from 1 to 5, and even more preferably from 1 to 3.

In the one or more Polyesters $A^a$, the ratio of the average number of repeating structural units resulting from monomer I) in the polymerization to the average number of repeating structural units resulting from the one or more monomers IV) in the polymerization is preferably from 2 to 8, more preferably from 3 to 5 and even more preferably 4.

In the polymerization reaction to prepare the Polyesters $A^a$, the molar ratio of monomer I) to monomers IV) is preferably from 2 to 8, more preferably from 3 to 5 and even more preferably 4.

In another further preferred embodiment of the inventive liquid laundry detergent compositions, the one or more polyesters of component a), described in the following and further referred to as "Polyester $B^a$", are obtainable through a polymerization reaction of the following monomers:

I) dimethyl terephthalate, and

II) ($HOC_3H_6OH$), and

III) one or more alkyl capped polyalkylene glycols of the formula $$X^a—(C_3H_6O)_p—(C_2H_4O)_q—Y$$

wherein $X^a$ is OH,

Y is a $C_{1-30}$ alkyl, preferably a $C_{1-4}$ alkyl and more preferably methyl, the ($C_3H_6O$)— and ($C_2H_4O$)-groups may be arranged blockwise, alternating, periodically and/or statistically, and wherein the connections of the groups ($C_3H_6O$)— and ($C_2H_4O$)— to X— and Y are free to vary, preferably blockwise wherein the ($C_3H_6O$)-block is connected to X— and the ($C_2H_4O$)-block is connected to Y, p is based on a molar average a number of from 0 to 20, preferably from 0 to 10 and more preferably from 0 to 5, q is based on a molar average a number of from 12 to 120, preferably from 30 to 60, and more preferably from 40 to 50, and IV) trimellitic acid anhydride.

In the one or more Polyesters $B^a$, the average number of repeating structural units resulting from the polymerization of monomer I) is preferably from 20 to 70, more preferably from 25 to 55, and even more preferably from 35 to 45.

In the one or more Polyesters $B^a$, the average number of repeating structural units resulting from the one or more monomers IV) in the polymerization is preferably from 1 to 15, more preferably from 5 to 13, and even more preferably from 8 to 12.

In the one or more Polyesters $B^a$, the ratio of the average number of repeating structural units resulting from monomer I) in the polymerization to the average number of repeating structural units resulting from the one or more monomers IV) in the polymerization is preferably from 2 to 8, more preferably from 3 to 5 and even more preferably 4.

In the polymerization reaction to prepare the Polyesters $B^a$, the molar ratio of monomer I) to monomers IV) is preferably from 2 to 8, more preferably from 3 to 5 and even more preferably 4.

In another further preferred embodiment of the inventive liquid laundry detergent compositions, the one or more polyesters of component a), described in the following and further referred to as "Polyester $C^a$", are obtainable through a polymerization reaction of the following monomers:

I) dimethyl terephthalate, and

II) ($HOC_3H_6OH$) and ($HOC_4H_8OH$) mixed in a ratio of preferably between 3 and 5 parts ($HOC_3H_6OH$) to 1 part ($HOC_4H_8OH$), and III) one or more alkyl capped polyalkylene glycols of the formula $$X^a—(C_3H_6O)_p—(C_2H_4O)_q—Y$$

wherein $X^a$ is $NH_2$,

Y is a $C_{1-30}$ alkyl, preferably a $C_{1-4}$ alkyl and more preferably methyl, the ($C_3H_6O$)— and ($C_2H_4O$)-groups may be arranged blockwise, alternating, periodically and/or statistically, preferably statistically, and wherein the connections of the groups ($C_3H_6O$)— and ($C_2H_4O$)— to X— and —Y are free to vary, p is based on a molar average a number of from 0 to 15, preferably from 2 to 15 and more preferably from 5 to 14, q is based on a molar average a number of from 12 to 120, preferably from 20 to 50, more preferably from 25 to 40, and even more preferably from 30 to 40, and IV) trimellitic acid anhydride.

In the one or more Polyesters $C^a$, the average number of repeating structural units resulting from monomer I) in the polymerization is preferably from 2 to 15, more preferably from 4 to 14, and even more preferably from 6 to 12.

In the one or more Polyesters $C^a$, the average number of repeating structural units resulting from the one or more monomers IV) in the polymerization is preferably from 1 to 10, more preferably from 1 to 5, and even more preferably from 1 to 3.

In the one or more Polyesters $C^a$, the ratio of the average number of repeating structural units resulting from monomer I) in the polymerization to the average number of repeating structural units resulting from the one or more monomers IV) in the polymerization is preferably from 2 to 8, more preferably from 3 to 5 and even more preferably 4.

In the polymerization reaction to prepare the Polyesters $C^a$, the molar ratio of monomer I) to monomers IV) is preferably from 2 to 8, more preferably from 3 to 5 and even more preferably 4.

In another further preferred embodiment of the inventive liquid laundry detergent compositions, the one or more polyesters of component a), described in the following and further referred to as "Polyester $D^a$", are obtainable through a polymerization reaction of the following monomers:

I) dimethyl terephthalate, and

II) ($HOC_3H_6OH$), and

III) one or more alkyl capped polyalkylene glycols of the formula $$X^a—(C_3H_6O)_p—(C_2H_4O)_q—Y$$

wherein $X^a$ is $NH_2$,

Y is a $C_{1-30}$ alkyl, preferably a $C_{1-4}$ alkyl and more preferably methyl, the ($C_3H_6O$)— and ($C_2H_4O$)-groups may be arranged blockwise, alternating, periodically and/or statistically, preferably statistically, and wherein the connections of the groups ($C_3H_6O$)— and ($C_2H_4O$)— to X— and —Y are free to vary, p is based on a molar average a number of from 0 to 15, preferably from 2 to 15 and more preferably from 5 to 14, q is based on a molar average a number of from 12 to 120, preferably from 20 to 50, more preferably from 25 to 40, and even more preferably from 30 to 40, and IV) pyromellitic acid dianhydride.

In the one or more Polyesters $D^a$, the average number of repeating structural units resulting from monomer I) in the polymerization is preferably from 3 to 20, more preferably from 4 to 15, and even more preferably from 4 to 10.

In the one or more Polyesters $D^a$, the average number of repeating structural units resulting from the one or more monomers IV) in the polymerization is preferably from 1 to 10, more preferably from 1 to 5, and even more preferably from 1 to 3.

In the one or more Polyesters $D^a$, the ratio of the average number of repeating structural units resulting from monomer I) in the polymerization to the average number of repeating structural units resulting from the one or more monomers IV) in the polymerization is preferably from 2 to 8, and more preferably from 3 to 7.

In the polymerization reaction to prepare the Polyesters $D^a$, the molar ratio of monomer I) to monomer IV) is preferably from 2 to 8, and more preferably from 3 to 7.

Preferably, the amount of the one or more Polyesters $A^a$, $B^a$, $C^a$ or $D^a$, resulting from monomers I), II), III) and IV) in the polymerization, based on the total weight of the one or more Polyesters $A^a$, $B^a$, $C^a$ or $D^a$ and excluding two terminal groups, is at least 30 wt.-%, more preferably at least 50 wt.-%, even more preferably at least 80 wt.-% and extraordinarily preferably at least 90 wt.-%.

The average molecular weight ($M_w$) of the one or more of Polyesters $A^a$, $B^a$, $C^a$ and $D^a$ is preferably from 3000 to 40000 g/mol.

The one or more polyesters of component a) are present in the inventive liquid laundry detergent compositions in an amount of preferably at least 0.1 wt.-%, more preferably from 0.1 wt.-% to 10 wt.-%, even more preferably from 0.2 wt.-% to 5 wt.-% and extraordinarily preferably from 0.25 wt.-% to 3 wt.-%, in each case based on the total weight of the liquid laundry detergent composition.

Surfactants

The inventive liquid laundry detergent compositions comprise one or more surfactants, component b).

Surfactants assist in removing soil from textile materials and also assist in maintaining removed soil in solution or suspension in the wash liquor.

Preferably, the one or more surfactants of component b) of the liquid laundry detergent compositions are selected from the group consisting of anionic, nonionic, cationic and zwitterionic surfactants, and more preferably from the group consisting of anionic, nonionic and zwitterionic surfactants.

Anionic Surfactants

Preferred anionic surfactants are alkyl sulfonates and alkyl ether sulfates.

Preferred alkyl sulfonates are alkylbenzene sulfonates, particularly linear alkylbenzene sulfonates (LAS) having an alkyl chain length of $C_8$-$C_{15}$. Possible counter ions for concentrated alkaline liquids are ammonium ions, e.g. those generated by the neutralization of alkylbenzene sulfonic acid with one or more ethanolamines, for example monoethanolamine (MEA) and triethanolamine (TEA), or alternatively, alkali metals, e.g. those arising from the neutralization of alkylbenzene sulfonic acid with alkali hydroxides. The linear alkyl benzene sulfonate surfactants may be LAS with an alkyl chain length of preferably from 8 to 15 and more preferably from 12 to 14. The neutralization of the acid may be performed before addition to the liquid laundry detergent compostitions or in the formulation process through excess addition of neutralizing agent.

Preferred alkyl ether sulfates (AES) are alkyl polyethoxylate sulfate anionic surfactants of the formula $$R^3O(C_2H_4O)_ySO_3^-M^+$$

wherein $R^3$ is a saturated or unsaturated alkyl chain having preferably from 10 to 22 carbon atoms, and more preferably from 12 to 16 carbon atoms, $M^+$ is a cation which makes the compound water-soluble, preferably an ammonium cation, a substituted ammonium cation, an alkali metal cation, or other material chosen from the list of buffers, y averages preferably from 1 to 15, more preferably from 1 to 3 and even more preferably is 3.

Nonionic Surfactants

Nonionic surfactants include primary and secondary alcohol ethoxylates, especially $C_8$-$C_{20}$ aliphatic alcohol ethoxylated with an average of from 1 to moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkyl polyglycosides, glycerol monoethers and polyhydroxy amides (glucamide). Mixtures of nonionic surfactant may be used.

When included therein, the liquid laundry detergent composition contains preferably from 0.2 wt.-% to 40 wt.-% and more preferably 1 wt.-% to 20 wt.-% of a nonionic surfactant, such as alcohol ethoxylate, nonylphenol ethoxylate, alkylpolyglycoside, alkyldimethylamineoxide, ethoxylated fatty acid monoethanolamide, fatty acid monoethanolamide, polyhydroxy alkyl fatty acid amide, or N-acyl N-alkyl derivatives of glucosamine ("glucamides").

Nonionic surfactants that may be used include the primary and secondary alcohol ethoxylates, especially the $C_8$-$C_{20}$ aliphatic alcohols ethoxylated with an average of from 1 to 35 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol.

Zwitterionic Surfactants

The liquid laundry detergent composition may comprise a zwitterionic surfactant, e.g. amine oxide or betaine, preferably in an amount of up to 10 wt.-% based on the total weight of the liquid laundry detergent composition.

Typical amine oxides used are of the formula $$R^4N(O)(CH_2R^5)_2$$

wherein $R^4$ is a long chain moiety and each $CH_2R^5$ are short chain moieties, $R^5$ is preferably selected from the group consisting of H, $CH_3$ and —$CH_2OH$.

In general $R^4$ is a primary or branched hydrocarbyl moiety with a chain length of from 8 to 18, which can be saturated or unsaturated. Preferably, $R^4$ is a primary alkyl moiety.

Preferred amine oxides have compositions wherein $R^4$ is a $C_8$-$C_{18}$ alkyl and $R^5$ is H. These amine oxides are illustrated by $C_{12-14}$ alkyldimethyl amine oxide, hexadecyl dimethylamine oxide, octadecylamine oxide.

A preferred amine oxide material is Lauryl dimethylamine oxide, also known as dodecyldimethylamine oxide or DDAO. Such an amine oxide material is commercially available from The Global Amines Company Pte. Ltd. under the trade name Genaminox® LA.

Betaines may be alkyldimethyl betaines or alkylamido betaines, wherein the alkyl groups have $C_{12-18}$ chains.

In one preferred embodiment of the invention, the one or more surfactants of component b) of the liquid laundry detergent compositions are selected from the group consisting of anionic and nonionic surfactants.

In another preferred embodiment of the invention, the one or more surfactants of component b) of the liquid laundry detergent compositions are selected from the group consisting of linear alkyl benzene sulfonates, alkyl ether sulfates, nonionic surfactants, amine oxides and betaines, and preferably the one or more surfactants of component b) of the liquid laundry detergent compositions are selected from the group consisting of linear alkyl benzene sulfonates, alkyl ether sulfates and nonionic surfactants.

Additional Surfactants

Other surfactants than the preferred LAS, AES, and nonionic surfactants may be added to the mixture of detersive surfactants.

Although less preferred, some alkyl sulfate surfactant may be used, especially the non-ethoxylated $C_{12-15}$ primary and secondary alkyl sulfates. Soap may also be used. Levels of soap are preferably lower than 10 wt.-%.

Preferably, the one or more surfactants of component b) of the inventive liquid laundry detergent compositions, are present in an amount of at least 5 wt.-%, more preferably from 5 wt.-% to 65 wt.-%, even more preferably from 6 to 60 wt.-% and extraordinarily preferably from 7 wt.-% to 55 wt.-%, in each case based on the total weight of the liquid laundry detergent composition.

Further Optional Ingredients

In addition to the essential ingredients as claimed, the liquid laundry detergent compositions may comprise one or more optional ingredients, e.g. they may comprise conventional ingredients commonly used in detergent compositions, especially laundry detergent compositions. Examples of optional ingredients include, but are not limited to builders, bleaching agents, bleach active compounds, bleach activators, bleach catalysts, photobleaches, dye transfer inhibitors, colour protection agents, anti-redeposition agents, dispersing agents, fabric softening and antistatic agents, fluorescent whitening agents, enzymes, enzyme stabilizing agents, foam regulators, defoamers, malodour reducers, preservatives, disinfecting agents, hydrotropes, fibre lubricants, anti-shrinkage agents, buffers, fragrances, processing aids, colorants, dyes, pigments, anti-corrosion agents, fillers, stabilizers and other conventional ingredients for washing or laundry detergent compositions.

Polyalkoxylated Polyethyleneimine

For detergency boosting, it is advantageous to use a second polymer alongside the soil release polymers in the liquid laundry detergent compositions of the present invention. This second polymer is preferably a polyalkoxylated polyethyleneimine (EPEI). Polyethylene imines are materials composed of ethylene imine units —$CH_2CH_2NH$— and, where branched, the hydrogen on the nitrogen is replaced by another chain of ethylene imine units. These polyethyleneimines can be prepared, for example, by polymerizing ethyleneimine in the presence of a catalyst such as carbon dioxide, sodium bisulfite, sulfuric acid, hydrogen peroxide, hydrochloric acid, acetic acid, and the like. Specific methods for preparing these polyamine backbones are disclosed in U.S. Pat. Nos. 2,182,306, 3,033,746, 2,208,095, 2,806,839, and 2,553,696.

Other Polymers

In addition to the polyester soil release polymer and the optional EPEI, the liquid laundry detergent compositions may comprise other polymeric materials, for example: dye transfer inhibition polymers, anti redeposition polymers and cotton soil release polymers, especially those based on modified cellulosic materials. Especially, when EPEI is not present, the liquid laundry detergent composition may further comprise a polymer of polyethylene glycol and vinyl acetate, for example the lightly grafted copolymers described in WO 2007/138054. Such amphiphilic graft polymers based on water soluble polyalkylene oxides as graft base and side chains formed by polymerisation of a vinyl ester component have the ability to enable reduction of surfactant levels whilst maintaining high levels of oily soil removal.

Hydrotropes

In the context of this invention a hydrotrope is a solvent that is neither water nor conventional surfactant that aids the solubilisation of the surfactants and other components, especially polymer and sequestrant, in the liquid to render it isotropic. Among suitable hydrotropes there may be mentioned as preferred: monopropylene glycol (MPG), glycerol, sodium cumene sulfonate, ethanol, other glycols, e.g. dipropylene glycol, diethers and urea. MPG and glycerol are preferred hydrotropes.

Enzymes

It is preferable that at least one or more enzymes selected from protease, mannanase, pectate lyase, cutinase, esterase, lipase, amylase, and cellulase may be present in the liquid laundry detergent compositions. Less preferred additional enzymes may be selected from peroxidase and oxidase. The enzymes are preferably present with corresponding enzyme stabilizers. The total enzyme content is preferably from 0 wt.-% to 5 wt.-%, more preferably from 0.5 wt.-% to 5 wt.-% and even more preferably from 1 wt.-% to 4 wt.-%.

Sequestrants

Sequestrants are preferably included. Preferred sequestrants include organic phosphonates, alkanehydroxy phosphonates and carboxylates available under the DEQUEST trade mark from Thermphos. The preferred sequestrant level is less than 10 wt.-% and preferably less than 5 wt.-% of the liquid laundry detergent composition. A particularly preferred sequestrant is HEDP (1-Hydroxyethylidene-1,1,-diphosphonic acid), for example sold as Dequest 2010. Also suitable but less preferred as it gives inferior cleaning results is Dequest® 2066 (diethylenetriamine penta(methylene-phosphonic acid) or Heptasodium DTPMP).

Buffers

In addition to agents optionally included for the generation of anionic surfactants, e.g. from LAS or fatty acids, the presence of buffer is preferred for pH control. Possible buffers are one or more ethanolamines, e.g. monoethanolamine (MEA) or triethanolamine (TEA). They are preferably used in the liquid laundry detergent composition at levels of from 1 to 15 wt.-%. Other suitable amino alcohol buffer materials may be selected from the group consisting of compounds having a molecular weight above 61 g/mol, which includes MEA. Suitable materials also include, in addition to the already mentioned materials: monoisopropanolamine, diisopropanolamine, triisopropanolamine, monoamino hexanol, 2-[(2-methoxyethyl) methylamino]-ethanol, propanolamine, N-methylethanolamine, diethanolamine, monobutanolamine, isobutanolamine, monopentanolamine, 1-amino-3-(2-methoxyethoxy)-2-propanol, 2-methyl-4-(methylamino)-2-butanol and mixtures thereof.

Potential alternatives to amino ethanol buffers are alkali hydroxides such as sodium hydroxide or potassium hydroxide.

It may be advantageous to include fluorescer and/or bleach catalyst in the liquid laundry detergent compositions as further high efficiency performance additives. Perfume and colorants will also desirably be included. The liquid laundry detergent compositions may additionally contain viscosity modifiers, foam boosting agents, preservatives (e.g. bactericides), pH buffering agents, polyelectrolytes, anti-shrinking agents, anti-wrinkle agents, anti-oxidants, sunscreens, anti-corrosion agents, drape imparting agents, anti-static agents and ironing aids. The liquid laundry detergent compositions may further comprise pearlisers and/or opacifiers or other visual cues and shading dye.

Packaging and Dosing

The liquid laundry detergent compositions may be packaged as unit doses in a polymeric film soluble in the wash water. Alternatively the liquids may be supplied in multidose plastics packs with a top or bottom closure. A dosing measure may be supplied with the pack either as a part of the cap or as an integrated system.

Further preferred embodiments of the invention may arise from the combination of above described preferred embodiments.

The invention will now be further described with reference to the following non-limiting examples.

EXAMPLES

The examples below are intended to illustrate the invention in detail without, however, limiting it thereto. Unless explicitly stated otherwise, all percentages given and relating to material amounts are percentages by weight (% by wt. or wt.-%).

Polymer Preparation

The polyesters of component a) of the inventive liquid laundry detergent compositions are prepared by methods well known to the person skilled in the art. A general description is given in the following.

A mixture of sodium acetate (NaOAc) and titanium isopropoxide (TIP) is preferably used as the catalyst system in the preparation.

The following abbreviations and materials are used:

Endcap 1 amine-terminated methyl-ethoxylated-propoxylated polyether with an average molecular weight of 2000 g/mol, an average molar ratio of EO to PO of 4 to 1 and the EO and PO units distributed statistically Endcap 2 monomethyl-ethoxylated-polyether with an average molecular weight of 2000 g/mol Endcap 3 monomethyl-ethoxylated-propoxylated polyether mono-ol with an average molecular weight of 2100 g/mol, the molar average number of EO units being 45, the molar average number of PO units being 2, and the EO and PO units being distributed blockwise TMAA Trimellitic acid anhydride PMADA Pyromellitic acid dianhydride DMT Dimethylterephthalate PG 1,2-propylene glycol BG 2,3-butylene glycol TIP titanium isopropoxide NaOAc sodium acetate a.m. active matter General Procedure for the Preparation of the Polyesters The polyester synthesis is carried out in either a two-step or a three-step procedure by the reaction of dimethyl terephthalate (DMT), a tri-basic or tetra-basic acid or acid anhydride, preferably trimellitic acid anhydride (TMAA) or pyromellitic acid dianhydride (PMADA), one or more alkylene glycols, preferably 1,2-propylene glycol (PG), alkyl capped polyalkylene glycol and optionally additional monomers V), using sodium acetate (NaOAc) and titanium isopropoxide (TIP) as the catalyst system.

In the three-step procedure, a precursor is first synthesized by reacting exclusively the relevant acid anhydride with the relevant alkyl capped polyalkylene glycol.

Precursor Synthesis (for Three Step Procedure)

The alkyl capped polyalkylene glycol is weighed into a five neck round-bottom flask and the contents heated to 50° C. under stirring and a continuous nitrogen flow of 5 l/h. The relevant acid anhydride is added and the mixture is stirred for 30 minutes at 50 to 60° C. and then for 1 hour at 150° C. After that the pressure is reduced to 10 mbar within 30 minutes. After 2 hours at 150° C./10 mbar the mixture is allowed to cool.

Transesterification

For the three step procedure, the DMT, one or more alkylene glycols, optional additional monomers V) and a catalytic amount of NaOAc are added to the five neck round-bottom flask containing the cooled precursor.

For the two step procedure, the alkyl capped polyalkylene glycol is weighed into a five neck round-bottom flask and the contents heated to 50° C. under stirring and a continuous nitrogen flow of 5 l/h. The acid anhydride, DMT, one or more alkylene glycols, optional additional monomers V) and a catalytic amount of NaOAc are then added.

For both the two-step and three-step procedures, the mixture is then carefully heated in 1 hour to 170° C. for melting and homogenization purposes. At a temperature of about 80'C the TIP (e.g. 0.2 g) is added. Within 1 hour the temperature is raised to 210° C. When the temperature inside the reaction vessel has reached 180° C., the reaction mixture is purged by a nitrogen stream (5 l/h). During the transesterification, methanol is formed and released from the reaction mixture and is distilled out of the system (distillation temperature <55° C.). After stirring the mixture for 2 hours at 210° C., the nitrogen stream is switched off and the pressure is reduced to 600 mbar within 1.5 hours. The pressure is then reduced to 500 mbar within 1.5 hours.

Polycondensation

The mixture is heated to 230° C. At this temperature the pressure is again set to 500 mbar over a time span of 20 minutes, to 200 mbar within 50 minutes and to mbar within 80 minutes. After that, the pressure is reduced within 10 minutes to 1 mbar. The mixture is stirred for 4 hours at 230° C. at 1 mbar. The reaction mixture is cooled down to 160° C. Vacuum is broken with nitrogen and the molten polymer is stored in a glass jar.

Example I—Three-step Procedure

Endcap 1+PG+TMAA

| Amount [g] | Raw Material [Abbreviation] |
|---|---|
| 19.2 | TMAA |
| 200 | Endcap 1 |
| 77.7 | DMT |
| 61.0 | PG |
| 0.5 | NaOAc |
| 0.2 | TIP |

Example II—Three-step Procedure

Endcap 1+PG/BG+TMAA

| Amount [g] | Raw Material [Abbreviation] |
|---|---|
| 19.2 | TMAA |
| 200 | Endcap 1 |
| 77.7 | DMT |
| 49.0 | PG |
| 14.0 | BG |
| 0.5 | NaOAc |
| 0.2 | TIP |

Example III—Three-step Procedure

Endcap 2+PG+TMAA

| Amount [g] | Raw Material [Abbreviation] |
|---|---|
| 19.2 | TMAA |
| 200 | Endcap 2 |
| 77.7 | DMT |
| 61.0 | PG |
| 0.5 | NaOAc |
| 0.2 | TIP |

Example IV—Two-step Procedure

Endcap 2+PG+TMAA

| Amount [g] | Raw Material [Abbreviation] |
|---|---|
| 19.2 | TMAA |
| 200 | Endcap 2 |
| 77.7 | DMT |
| 61.0 | PG |
| 0.5 | NaOAc |
| 0.2 | TIP |

Example V—Three-step Procedure

Endcap 3+PG+TMAA

| Amount [g] | Raw Material [Abbreviation] |
|---|---|
| 19.2 | TMAA |
| 200 | Endcap 3 |
| 77.7 | DMT |
| 61.0 | PG |

-continued

| Amount [g] | Raw Material [Abbreviation] |
|---|---|
| 0.5 | NaOAc |
| 0.2 | TIP |

Example VI—Two-step Procedure

Endcap 3+PG+TMAA

| Amount [g] | Raw Material [Abbreviation] |
|---|---|
| 19.2 | TMAA |
| 200 | Endcap 3 |
| 77.7 | DMT |
| 61.0 | PG |
| 0.5 | NaOAc |
| 0.2 | TIP |

Example VII—Three-step Procedure

Endcap 1+PG+PMADA

| Amount [g] | Raw Material [Abbreviation] |
|---|---|
| 10.9 | PMADA |
| 200 | Endcap 1 |
| 48.6 | DMT |
| 38.1 | PG |
| 0.5 | NaOAc |
| 0.2 | TIP |

Liquid laundry detergent compositions containing exemplary polyesters A series of liquid laundry detergent compositions comprising the exemplary polyester prepared according to Example I, were prepared according to Table A in order to demonstrate the ability of incorporating the polyesters into laundry compositions.

TABLE A

Compositions containing polyester from Example I

| | wt.-% a.m. | | | | | | |
|---|---|---|---|---|---|---|---|
| Ingredient | 1 | 2 | 3 | 4 | 5 | 6 | 7 |
| LAS | 5.2 | 5.2 | 6.0 | 9.0 | 11.2 | 12.0 | 14.3 |
| SLES 2EO | 6.5 | 6.5 | 6.0 | 9.0 | 4.2 | 9.0 | 0.0 |
| NI 7EO | 5.2 | 5.2 | 12.6 | 8.4 | 8.8 | 6.3 | 10.0 |
| Fatty Acid | 2.8 | 2.8 | 5.4 | 3.6 | 3.8 | 2.7 | 4.3 |
| Propylene Glycol | 0.0 | 0.0 | 5.0 | 5.0 | 4.8 | 5.0 | 4.9 |
| Glycerol | 2.4 | 2.4 | 0.8 | 0.8 | 0.8 | 0.8 | 0.8 |
| Ethanol | 1.2 | 1.2 | 0.0 | 0.0 | 0.0 | 0.0 | 0.0 |
| Citric Acid | 1.7 | 1.7 | 3.9 | 3.9 | 3.7 | 3.9 | 3.7 |
| Sodium tetraborate decahydrate | 2.0 | 2.0 | 0.0 | 0.0 | 0.0 | 0.0 | 0.0 |
| SRP1 | 1.0 | 1.0 | 1.0 | 1.0 | 1.0 | 1.0 | 1.0 |
| Demin water and NaOH to adjust pH | ad 100 | ad 100 | ad 100 | ad 100 | — | — | — |
| Demin water and TEA to adjust pH | — | — | — | — | ad 100 | ad 100 | ad 100 |
| pH Value | 8.5 | 8.5 | 7.5 | 7.6 | 7.5 | 7.6 | 7.6 |
| Appearance at room temperature | clear | clear | clear | clear | clear | clear | clear |

Key to Ingredients Used in the Compositions of Tables A and B:

LAS is $C_{12-14}$ linear alkylbenzene sulfonate, sodium salt

SLES 2EO is sodium lauryl ether sulfate with 2 moles EO (Genapol® LRO, Clariant).

NI 7EO is $C_{12-15}$ alcohol ethoxylate 7EO nonionic (Genapol® LA070, Clariant)

Fatty Acid is a $C_{12-18}$ stripped palm kernel fatty acid

SRP1 is a polyester prepared according to Example I

TEA triethanolamine

Stability Test in Detergent Composition

A series of exemplary liquid laundry detergent compositions, both excluding and including soil release polymer, were prepared according to Table B. Samples 1 to 4 include sodium hydroxide as the buffering system. Samples 5 to 7 contain triethanolamine as the buffering system. Those compositions containing soil release polymer were subjected to storage tests in order to determine the hydrolytic stability of the polymers.

TABLE B

Liquid laundry detergent compositions for hydrolytic stability testing

| | wt.-% a.m. | | | | | | |
|---|---|---|---|---|---|---|---|
| Ingredient | 1 | 2 | 3 | 4 | 5 | 6 | 7 |
| LAS | 5.20 | 5.20 | 5.20 | 5.20 | 5.20 | 5.20 | 5.20 |
| SLES 2EO | 6.50 | 6.50 | 6.50 | 6.50 | 6.50 | 6.50 | 6.50 |
| NI 7EO | 5.20 | 5.20 | 5.20 | 5.20 | 5.20 | 5.20 | 5.20 |
| Fatty Acid | 2.80 | 2.80 | 2.80 | 2.80 | 2.80 | 2.80 | 2.80 |
| Glycerol | 2.40 | 2.40 | 2.40 | 2.40 | 2.40 | 2.40 | 2.40 |
| Ethanol | 1.20 | 1.20 | 1.20 | 1.20 | 1.20 | 1.20 | 1.20 |
| Sodium citrate | 1.70 | 1.70 | 1.70 | 1.70 | 1.70 | 1.70 | 1.70 |
| Sodium tetraborate decahydrate | 2.00 | 2.00 | 2.00 | 2.00 | 2.00 | 2.00 | 2.00 |
| TexCare ® SRN170 | 0.00 | 1.00 | 0.00 | 0.00 | 0.00 | 1.00 | 0.00 |
| SRP1 | 0.00 | 0.00 | 1.00 | 0.00 | 0.00 | 0.00 | 1.00 |
| SRP2 | 0.00 | 0.00 | 0.00 | 1.00 | 0.00 | 0.00 | 0.00 |
| Demin water and NaOH to adjust pH | ad 100 | ad 100 | ad 100 | ad 100 | — | — | — |
| Demin water and TEA to adjust pH | — | — | — | — | ad 100 | ad 100 | ad 100 |
| pH Value | 8.4 | 8.4 | 8.4 | 8.4 | 8.4 | 8.4 | 8.4 |
| Appearance at room temperature | clear | clear | clear | clear | clear | clear | clear |

Key to Ingredients Used:

TexCare® SRN170 is a comparative soil release polymer comprising —OOC-(1,4-phenylene)-COO— structural units and —O—$CH_2CH_2$—O— structural units, i.e. comprising only repeating structural units (a1) of the polyesters of component a) contained in the inventive liquid laundry detergent compositions, and no repeating structural units (a2) of the polyesters of component a) contained in the inventive liquid laundry detergent compositions SRP2 is a polyester prepared according to Example III Soil Release Test The inventive liquid laundry detergent compositions containing the polyesters of component a) and prepared according to the compositions listed in Table B, were tested for their soil release performance according to the "Dirty-Motor Oil" Test (DMO-Test) using a Lini Apparatus. The conditions for the test are listed in Table C.

TABLE C

Washing conditions - Soil Release Test

| | |
|---|---|
| Equipment | Linitest Plus (SDL Atlas) |
| Water hardness | 14° dH |
| Washing temperature | 40° C. |
| Washing time | 30 min |
| Detergent concentration | 4.3 g/l |
| Soiled Fabric:Liquor Ratio | 1:40 |

As test fabric, white polyester standard swatches (WFK 30A, from WFK Testgewebe GmbH) were used. The fabrics were prewashed three times with the stored liquid laundry detergent compositions. The swatches were then rinsed, dried and soiled with 25 μl of dirty motor oil. After 1 hour the soiled fabrics were washed again with the same stored liquid laundry detergent compositions used in the prewashing step. After rinsing and drying the washed swatches, a measurement of the remission of the stained fabric at 457 nm was made using a spectrophotometer (Datacolor 650).

Based on the remission of the clean unstained swatch, $R_c$, the stained swatches before washing, $R_u$, and the washed swatch, $R_w$, a soil release index (SRI) can be defined:

$$SRI = \frac{(R_w - R_u)}{(R_c - R_u)} \times 100$$

As the soil removal will also depend on the performance of the detergent without polymer, a normalized value, $SRI_{norm}$, can be measured by dividing the value for SRI with polymer by the SRI value without polymer. The resulting quantity no longer depends on $R_c$ and hence simplifies the measurement and calculation. The case of no improvement over the base detergent would deliver a value of 1, hence subtracting 1 will reset the baseline to 0, thus:

$$SRI_{norm} = \frac{(R_w - R_u)_{with\ polymer}}{(R_w - R_u)_{without\ polymer}} - 1$$

The washing results obtained for the stored liquid laundry detergent compositions comprising the soil release polymers are shown in Table D. The values are normalized to the value obtained from a freshly prepared sample of TexCare® SRN170.

Hydrolysis Determination

One of the main products from the hydrolysis of soil release polyesters under alkaline conditions is terephthalic acid. The hydrolytic stability was thus monitored by measuring the terephthalic acid content by HPLC.

HPLC analysis: 10 μl sample was injected onto a Synergi Polar RP column of dimensions 250×4.6 mm with porosity 80 Å and particle size 4 μm. The detection was monitored at 240 nm on a diode array detector. The gradient was made with two eluents. The eluent A was 0.005 mol/l of tetrabutylammonium bisulfate in a 95/5% (v/v) water/acetonitrile mixture. The eluent B was a 5/95% (v/v) water/acetonitrile mixture. Separations were conducted at a flow-rate of 1 ml/min. Quantification was performed by externally calibrating solutions of terephthalic acid in the range 1 to 30 mg/kg.

The samples were independently fully hydrolysed in order to determine the maximum concentration of free terephthalic acid achievable. This was performed by adding 300 mg of the polymer to a vial with 3 g KOH solution (2 mol/dm$^3$) and 15 g water and then heating the solution to 130° C. where it was maintained for 1.5 hours. After cooling, the solution was diluted to 1 wt.-% and the terephthalic acid content measured as described via HPLC. The concentrations (measured in mg/kg) were then converted into a percentage of the maximum possible terephthalic acid concentration. The values for the degree of hydrolysis thus calculated are shown in Table D.

The prepared compositions were stored at 40° C. for 28 days. The hydrolysis of the polyesters was then determined by measuring the concentration of terephthalic acid by HPLC analysis. The values reported in Table D are also shown relative to the value obtained for aged samples of TexCare® SRN170, namely compositions 2 and 6 in Table B.

TABLE D

Stability of compositions prepared according to Table B

| Detergent composition from Table B | Degree of hydrolysis after 28 days at 40° C. [%] | Relative degree of hydrolysis after 28 days at 40° C. [%] | $SRI_{norm}$ $SRI_{norm}$ (TexCare SRN170 fresh) [%] |
|---|---|---|---|
| 1 (comparative) | — | — | 0 |
| 2 (comparative) | 49 | 100 | 24 |
| 3 (inventive) | 9 | 19 | 107 |
| 4 (inventive) | 10 | 21 | 78 |
| 5 (comparative) | — | — | 0 |
| 6 (comparative) | 67 | 100 | 7 |
| 7 (inventive) | 19 | 29 | 58 |

Primary Detergency

Inventive liquid laundry detergent compositions containing the polyesters of component a) exhibit advantageous soil removal of oily and fatty stains from polyester containing fabrics. Compositions 1 (containing no polymer) and 3 (containing a polyester prepared according to Example 1) from Table B were tested according to the test protocol detailed in Table E. The stained fabrics were used as purchased from the Center for Test Materials, Holland. Color measurements were performed before washing and after one wash cycle and the CIE-L*, a* and b* values noted. The performance was measured by calculating the value of ΔE according to the following formula:

$$\Delta E = \sqrt{(L^*_{unwashed} - L^*_{washed})^2 + (a^*_{unwashed} - a^*_{washed})^2 + (b^*_{unwashed} - b^*_{washed})^2}\ .$$

TABLE E

Washing conditions - Primary Detergency

| | |
|---|---|
| Equipment | Miele frontloading washing machine, W1935 WPS WTL |
| Water hardness | 14° dH |
| Washing temperature | 40° C. |
| Washing program | Cotton |
| Detergent concentration | 4.3 g/l |
| Ballast | 3 kg cotton |
| Soil Ballast Load (SBL) | 3 SBL towels (from CFT, Holland) |

The results of primary detergency are shown in Table F.

TABLE F

Primary Detergency Results

| | Polyester ΔE | | Polyester-Cotton ΔE | |
|---|---|---|---|---|
| Stain | Composition 1 (comparative) | Composition 3 (inventive) | Composition 1 (comparative) | Composition 3 (inventive) |
| Olive oil with carbon black | 17 | 26.9 | 5.6 | 13.1 |
| Pigment/sebum | 16.2 | 20.7 | 6.7 | 19.5 |
| Fluid make up | 24.5 | 23.9 | 7.7 | 20.2 |
| Lipstick red, diluted | 30.8 | 35.4 | 14.6 | 27.5 |

The invention claimed is:

1. A liquid laundry detergent composition comprising a) at least one polyester having an average molecular weight ($M_w$) from 3000 to 40000 g/mol comprising at least one of the repeating structural unit (a1) and at least one of the repeating structural unit (a2)

(a1)

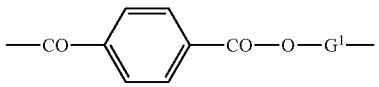

(a2)

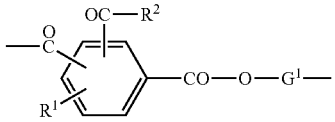

wherein $G^1$ is at least one of $(C_2H_4O)$, $(C_3H_6O)$ or $(C_4H_8O)$, $R^1$ is H or $COR^2$, $R^2$ is $X—(C_3H_6O)_p—(C_2H_4O)_q—Y$ wherein X is NH, Y is a $C_{1-4}$ alkyl the $(C_3H_6O)$— and $(C_2H_4O)$-groups may be arranged blockwise, alternating, periodically and/or statistically, and wherein the connections of the groups $(C_3H_6O)$— and $(C_2H_4O)$— to X— and —Y are free to vary, p is based on a molar average, a number of from 0 to 60, q is based on a molar average, a number of from 1 to 300, wherein the polyesters besides the at least one repeating structural unit comprise terminal groups which are connected to the CO group of the repeating structural units (a1) and (a2) and which are selected from the group consisting of HO, $OCH_3$, $HOG^1$ and $R^2$ or which are connected to the $G^1$ group of the repeating structural units (a1) and (a2) and which are selected from the group consisting of H, $CO(C_6H_4)COR^2$ and $CO(C_6H_2)COR^2R^1COR^2$, wherein $R^1$ and $R^2$ are defined above, and b) at least one surfactant, wherein the at least one polyester of component a) are present in an amount from 0.1 wt.-% to 10 wt.-%, based on the total weight of the liquid laundry detergent composition, and the at least one surfactant of component b) are present in an amount from 5 wt.-% to 65 wt.-%, based on the total weight of the liquid laundry detergent composition.

2. The liquid laundry detergent composition according to claim 1, wherein the at least one repeating structural unit (a2) is selected from the group consisting of the repeating structural units (a2.1) and (a2.2)

(a2.1)

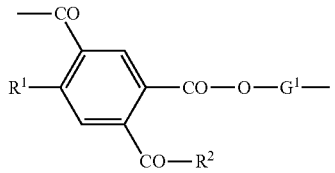

(a2.2)

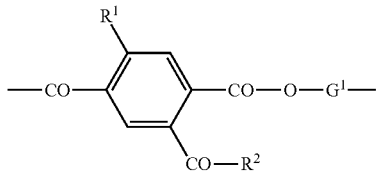

3. The liquid laundry detergent composition according to claim 1, wherein the sum of p and q, based on a molar average, is a number of from 1 to 360.

4. The liquid laundry detergent composition according to claim 1, wherein the at least one polyester of component a) additionally comprises at least one of the repeating structural unit (a3)

(a3)

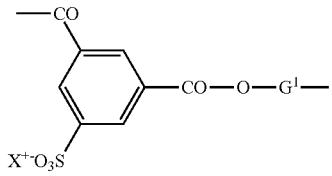

wherein $G^1$ is at least one of $(C_2H_4O)$, $(C_3H_6O)$ or $(C_4H_8O)$, and $X^+$ is a counter-ion.

5. The liquid laundry detergent composition according to claim 1, wherein the average number of repeating structural unit (a1) in the at least one polyester of component a) is from 2 to 200, and the average number of repeating structural unit (a2) in the at least one polyester of component a) is from 1 to 25.

6. The liquid laundry detergent composition according to claim 1, wherein the ratio of the average number of repeating structural unit (a1) in the at least one polyester of component a) to the average number of repeating structural unit (a2) in the at least one polyester of component a) is from 2 to 8.

7. The liquid laundry detergent composition according to claim 1, wherein the total amount of repeating structural units (a1) and (a2) in the at least one polyester of component a), based on the total weight of the at least one polyester of component a), is at least 30 wt.-%.

8. The liquid laundry detergent composition according to claim 4, wherein the amount of repeating structural unit (a3) in the at least one polyester of component a), based on the total weight of the at least one polyester of component a), is at least 0.1 wt.-%.

9. The liquid laundry detergent composition according to claim 1, wherein the repeating structural units of the at least one polyester of component a) are exclusively selected from the group consisting of repeating structural units (a1) and (a2).

10. The liquid laundry detergent composition according to claim 1, wherein $G^1$ is $(C_3H_6O)$.

11. The liquid laundry detergent composition according to claim 1, wherein the at least one polyester of component a) comprise repeating structural units exclusively selected from the group consisting of the repeating structural units (a1) and (a2), whereby at least one of the repeating structural unit (a1) and at least one of the repeating structural unit (a2) must be present (a1)

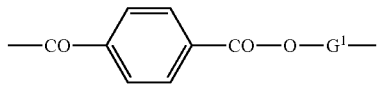

(a2)

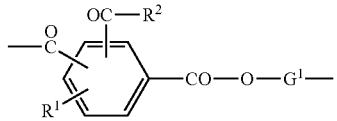

wherein $G^1$ is $(C_3H_6O)$, $R^1$ is H, $R^2$ is $X—(C_3H_6O)_p—(C_2H_4O)_q—Y$ wherein X is NH, Y is a $C_{1-4}$ alkyl, the $(C_3H_6O)$— and $(C_2H_4O)$-groups may be arranged blockwise, alternating, periodically and/or statistically, and wherein the connections of the groups $(C_3H_6O)$— and $(C_2H_4O)$— to X— and —Y are free to vary, p is based on a molar average, a number of from 0 to 15, q is based on a molar average, a number of from 12 to 120.

12. The liquid laundry detergent composition according to claim 11, wherein p, based on a molar average, is a number of from 2 to 15.

13. The liquid laundry detergent composition according to claim 1, wherein the at least one polyester of component a) is present in an amount from 0.2 wt.-% to 5 wt.-% based on the total weight of the liquid laundry detergent composition.

14. The liquid laundry detergent composition according to claim 1, wherein the at least one surfactant of component b) is selected from the group consisting of anionic, nonionic, cationic and zwitterionic surfactants.

15. The liquid laundry detergent composition according to claim 14, wherein the at least one surfactant of component b) is selected from the group consisting of linear alkyl benzene sulfonates, alkyl ether sulfates, nonionic surfactants, amine oxides and betaines.

16. The liquid laundry detergent composition according to claim 1, wherein the at least one surfactant of component b) is present in an amount from 6 to 60 wt.-% based on the total weight of the liquid laundry detergent composition.

* * * * *